United States Patent [19]

Antonious

[11] Patent Number: 4,930,783

[45] Date of Patent: Jun. 5, 1990

[54] GOLF CLUB

[76] Inventor: Anthony J. Antonious, Towson, Md.

[21] Appl. No.: 651,716

[22] Filed: Sep. 18, 1984

Related U.S. Application Data

[63] Continuation-in-part of Ser. No. 543,232, Oct. 21, 1983, abandoned, which is a continuation of Ser. No. 263,517, May 14, 1981, abandoned, which is a continuation-in-part of Ser. No. 134,985, Mar. 28, 1980, abandoned, which is a continuation of Ser. No. 896,594, Apr. 14, 1978, abandoned.

[51] Int. Cl.[5] ..... A63B 53/04

[52] U.S. Cl. ..... 273/164; 273/169; 273/175

[58] Field of Search ..... 273/167 E, 167 A, 193 R, 273/174

[56] References Cited

U.S. PATENT DOCUMENTS

| | | | |
|---|---|---|---|
| 2,550,846 | 5/1951 | Milligan | 273/167 E |
| 3,035,839 | 5/1962 | Coglianese | 273/167 A |
| 3,126,206 | 3/1967 | Sabia | 273/193 R |

FOREIGN PATENT DOCUMENTS

| | | | |
|---|---|---|---|
| 150528 | 3/1953 | Australia | 273/167 E |
| 538 | 1/1977 | Japan | 273/167 E |
| 340579 | 1/1931 | United Kingdom | 273/174 |

*Primary Examiner*—George J. Marlo

*Attorney, Agent, or Firm*—Finnegan, Henderson, Farrabow, Garrett and Dunner

[57] ABSTRACT

A wood-type golf club with a club head having an improved aerodynamic shape to reduce drag, increase club head lift, improve sensation and control as the club head is swung and increase club head stability at impact, the club head having a deep, channel-shaped cavity formed in the top surface of the club extending rearwardly from the ball striking face. The cavity includes an ari flow restriction formed between the ball striking face and the rear face. The cavity is defined by various parameters including width and depth wherein the width of the cavity is substantially greater than the depth, the depth being at least ¼ inch from the top surface of the club head and the width being at least ½ inch.

37 Claims, 9 Drawing Sheets

GOLF CLUB

BACKGROUND OF THE INVENTION

1. Field of the Invention

This application is a continuation-in-part application of application Ser. No. 543,232, filed on Oct. 21, 1983, which was a continuation of application Ser. No. 263,517, filed May 14, 1981, which was a continuation-in-part of application Ser. No. 134,985, filed Mar. 28, 1980, which was a continuation of Ser. No. 896,594, filed Apr. 14, 1978. Each of the above applications are now abandoned.

This invention relates to golf clubs and, more particularly, to wood-type golf club heads having aerodynamic designs to reduce drag, increase club head lift, and stabilize the club head during its swing and specifically at impact.

2. Discussion of the Prior Art

In playing golf, wood-type golf clubs are used for hitting a golf ball a longer distance. Normally, a wood driver is used for the first shot of a given hole to obtain maximum distance from the tee. However, other woods, knows as fairway woods, are used for subsequent shots that require the ball to travel long distances toward or onto the putting green. The force with which a golf ball is struck depends upon the mass of the club head and the club head acceleration at the moment of impact with the ball in accordance with well known laws of physics. Clubs are made with various swing weights to achieve optimum speed and control by a particular player using a club.

Modern technological developments have provided improved golf club shafts of lighter weight material so that the club head can be swung with greater speed and acceleration while maintaining the weight of the club head to impart maximum force upon the ball. The typical wood type golf club has a broad face and an asymmetric shape which does not provide the best configuration from the standpoint of aerodynamic drag.

Some efforts have been made to increase club head speed by reducing aerodynamic drag as shown in my prior U.S. Pat. No. 3,468,544. Another patent of interest is U.S. Pat. No. 2,550,846 to Milligan which shows a golf club having a shallow recess in the top surface in the form of a shallow streamlined groove which is claimed to impart spin to a ball as it is struck. Another prior patent to Gordos (4,065,133) shows a golf club having a plurality of spaced grooves which are deep, but the depth is at least as great as the width and the individual grooves are relatively small and narrow compared to the overall size of the club head. The patent to Goldberg (3,997,170) shows a golf club having a plurality of parallel grooves which are also relatively shallow and small with respect to the overall club head size. Still another prior art patent to Cullenizi (3,035,839) shows a golf club having a sighting alignment slot in the top of a club which is relatively narrow with respect to the overall club head size.

The above designs do not significantly reduce drag or increase club head speed and lift, as does the present invention. Some of the designs are also aesthetically unpleasing or do not conform to the Rules of Golf defining the structure of a golf club as established by the U.S. Golf Association.

SUMMARY OF THE INVENTION

The present invention is directed to a golf club structure which achieves increased club head speed when it is swung without the need for changing the overall length, weight or other major characteristics of the club. This is accomplished by reducing the aerodynamic drag on the club head as it is swung, thus enabling a player using the club to hit a ball further without exerting additional force during a swing. The arrangement also provides aerodynamic stability which permits increased awareness and control of the club head position, thereby producing a more consistent swing and greater accuracy. In addition, the invention increases the aerodynamic lift on the club head, thereby making the club head swing and feel lighter. The sum of the effects provided by the invention is to provide the user with increased distance and more directed flight of the golf ball.

The golf club of the present invention is provided with a deep cavity in the top surface of the club head extending rearwardly from the ball striking face. The cavity contains an air flow restriction formed between the ball striking face and the rear face. The restriction may take the form of a venturi configuration which increases lift, reduces drag and provides for improved control as the head is swung. As the club is swung, air flowing across the top of the club head through the cavity with the restriction alters what conventionally is a region of low pressure behind the club head to a higher pressure. This increase in pressure at the rear of the club counteracts the even higher aerodynamic pressure on the face of the club and decreases the aerodynamic drag on the club. The shape and size of the cavity which produces the improved results is characterized by a number of parameters including width and depth, aspect ratio and average transverse gradient. The aspect ratio is a recognized aerodynamic parameter and is defined as the square of the width between the top edges of the cavity at a transverse cross section of the cavity divided by the cross sectional area at that transverse cross section.

The transverse gradient is another aerodynamic parameter and is defined as the angle between a first line from the bottom low point of a cavity at a transverse cross section of the cavity to the highest edge of the cavity and a second line across the highest point at the top edge of the cavity such that the second line forms a right angle with a vertical line through the bottom of the cavity at the deepest point. The bottom low point is further defined as the lowermost portion of the cavity at a given transverse cross section of the cavity. When the cavity has a symmetrical configuration, the bottom low point would be equidistant from the edges of the cavity or along the longitudinal center line of the cavity. When the cavity is asymmetrical, the bottom low point does not coincide with and would be spaced from the longitudinal center line of the cavity. For asymmetrical cavities, there will be two separate and different transverse gradient angles, one for each edge. When the cavity is asymmetrical, the transverse gradient is measured from the deepest or lowest part of the cavity below the top surface of the club head. For such cavities, some aspects of the aerodynamic characteristics of the cavity can be characterized by an average transverse gradient at a given cross section which is calculated by adding both transverse gradient angles and dividing by two.

Optimum results are produced with a cavity wherein: the depth of the cavity is equal or greater than ¼ inch below the top surface of the club head and the width of the cavity is at least ½ inch wide and is substantially greater than the depth, the aspect ratio of the cavity is less than 20, the average transverse gradient of the cavity is greater than 3 degrees, and the cavity includes a restriction at a point or points along its length.

The restriction in the cavity may take the form of several shapes including narrow cavity walls at various points along the longitudinal dimension of the cavity, and spacers positioned within the cavity. Other aerodynamic shapes and venturi type surfaces, such as air foil type surfaces, may be used within the scope of the present invention.

When the club head with the present invention is swung at high velocities, the cavity achieves a significant channeling and retention of higher energy air into the club head wake at the rear of the club. The walls of the cavity provide sufficient depth to contain and direct a jet-type air flow immediately at the back of the club head. The upper, elongated edges of the cavity provide a stabilizing effect on the air flow since they define a flow line that is independent of the club head speed and therefore function in a consistent manner throughout a golfer's swing from start to maximum speed when the ball is struck. These edges assist in maintaining the air flow patterns independent of the aerodynamic Reynold's number. The front edge of the cavity at the club head face should be designed to eliminate or minimize turbulent air flow and achieve as laminar an air flow pattern as possible at this introduction point, and the cavity along its length must be streamlined to channel and retain the high velocity laminar air flow throughout the length of the club. The restriction provides a venturi effect which tends to accelerate the air before it is exhausted out of the rear portion of the club head. A cavity having these characteristics provides an increased flow of high energy air into the club head wake which produces a higher pressure at the rear of the club head than exists in regular clubs not having the present invention. The cavity has a pronounced effect on reducing drag, thereby allowing higher club head speeds and a larger energy transfer to golf balls being struck.

A cavity with the above characteristics provides significant improvements over the prior art clubs. Such a cavity may be symmetrical or asymmetrical at its transverse cross sections, and may have various shapes such as rectangular (where the bottom and sides meet at a 90° angle), rounded, or a variety of other cross sectional configurations which meet the above parameters.

Accordingly, it is a primary object of the present invention to overcome the above mentioned disadvantages of the prior art by aerodynamically designing a club head to substantially reduce drag, minimize turbulent air flow and improve swing stability, while being aesthetically pleasing and conforming to the established U.S.G.A. Rules of Golf.

A further object of the present invention is to provide a golf club head which increases club head lift as the club head is swung, thereby reducing the apparent swing weight of the club head and enabling additional acceleration for a given force resulting in a higher club head speed at impact with the golf ball.

Another object of the present invention is to provide a golf club head that provides greater aerodynamic stability and increased awareness of the club face position, thereby producing greater control of the club as it is swung to produce a more consistent swing and greater accuracy.

Yet another object of the present invention is to provide a golf club head which at the bottom of the swing plane is induced to stay close to the ground for a longer and flatter swing plane than conventional clubs. This effect is created by the improved aerodynamics of the cavity when in the vicinity of the ground.

Other objectives and advantages of the present invention will become apparent from the following description of the preferred embodiments taken in conjunction with the accompanying drawings. The objectives and advantages of the invention will be realized and attained by means of the elements, limitations and combinations particularly pointed out in the appended claims.

To achieve the objectives and in accordance with the purpose of the invention, as embodied and broadly described herein, the invention comprises a club head for a wood-type golf club to be swung at high velocities, the club head having a ball striking face, a rear face, a heel, a toe, a top surface and a bottom, the ball striking face being made to strike a golf ball and having a height which is at least 50% of the distance between the top surface and the bottom surface of the club head. The golf club head includes aerodynamic means for (1) raising the pressure at the rear of the club head and thus reducing the aerodynamic drag on the club head to provide greater acceleration for increased club head speed, (2) increasing the aerodynamic lift on the club head to provide a lighter swing feel, and (3) stabilizing the club head both during its swing and at impact to facilitate a repetitive optimum club face position, thus providing improved directional control of the resultant golf shot. The aerodynamic means includes an elongated, deep and streamlined cavity having side walls and a bottom surface which form an air channel of sufficient depth and width to channel, retain and exhaust a high energy flow of air directly behind the club head into the club head near wake, the cavity being located in the top surface of the club head and extending substantially perpendicular to and rearwardly from the ball striking face to the rear face and forming two elongated top edges at the juncture with the top surface of the club head. The edges provide a stabilizing effect on the flow of high speed air by defining flow lines independent of club head speed. The cavity further includes an air flow restriction formed between the ball striking face and the rear face. The cavity has a depth of at least ¼ inch and a width which is at least ½ inch along a substantial portion of its length. Generally, the cavity should have an average aspect ratio which is less than 20, and more preferably less than 8, along a substantial portion of its length. The presently disclosed cavity takes the form of a venturi configuration which provides increased acceleration of the air flow, the resultant cavity, causing the flow of air through the cavity, as the club head is swung at high velocities, to raise the pressure at the rear of the club head and act as a vertical stabilizer, thereby helping to maintain alignment of the club head on its swing path.

It is to be understood that the foregoing general description and the following detailed description are exemplary and explanatory only and are not restrictive of the invention, as claimed.

The accompanying drawings, which are incorporated in and constitute a part of this specification, illustrate several embodiments of the invention and, together with the description, serve to explain the principles of the invention.

DESCRIPTION OF THE PREFERRED EMBODIMENT

Reference is now made in detail to the present preferred embodiments of the invention, examples of which are illustrated in the accompanying drawings.

The golf club of the present invention is provided with an improved aerodynamic shape to substantially alter the air flow pattern moving across the top of the club head. The aerodynamic shape causes a reduction in drag, a reduction in turbulent air flow and an increase in lift for considerable improvement in the stability of the club head resulting in increased speed, a lighter feel and better control when a golf club is swung at high velocities.

The top of the club head is provided with a deep cavity across the top surface extending substantially perpendicular to and rearwardly from the ball striking face. The cavity includes a restriction or narrowing of the cavity parameters along a longitudinal axis between the ball striking face and the rear of the golf club head. The restriction may have the shape of a venturi, that is, with an inlet section, an outlet section and a section with a narrow throat. Other aerodynamic configurations may be used.

Figure 4:
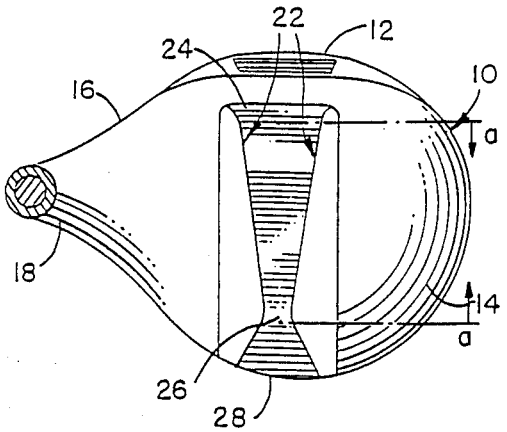
FIG. 4 is a top plan view of the club head of FIG. 3.

As is shown, for example, in FIG. 4, the top of the club head 10 is provided with a deep cavity 22 across the top surface of the club head extending substantially perpendicular to and rearwardly from the ball striking face 12. The club head further includes a throat or restriction 26. This restriction acts as a venturi to accelerate the flow of air into the near wake at the rear of the club. For example, the cross sectional shape of the cavity may be rounded, rectangular or any other irregular shape. Various designs in the cross sectional shape may be used in keeping within the scope of the present invention as long as certain aerodynamic design parameters are achieved and the depth and width of the cavity are significant with respect to the overall club head dimensions.

To be effective, the cavity must achieve a significant channeling and retention of higher energy air into the club head wake at the rear of the club. The walls of the cavity must provide sufficient depth to contain and direct a jet-type air flow immediately at the back of the club head when the club head is swung. The cavity should form upper, elongated longitudinal edges at the top surface of the club head to provide a stabilizing effect on the flow of high velocity air. These longitudinal edges define continuous flow lines that are independent of the club head speed and therefore function in a consistent manner throughout a golfer's swing from start to maximum speed when the ball is struck. These flow lines assist in the retention and channeling of air.

The transverse horizontal front edge 24 of the cavity adjacent the club head face should preferably be designed to minimize turbulent air flow in order to achieve as laminar a flow pattern as possible at this introduction point of the air flow to the cavity. In addition, it is preferable that the front vertical edges of the channel be rounded to effect the optimum ducting and transition of air flow from the front of the club head into the channel. The design of this invention provides a smooth transition of air flow, minimizes the separation of air away from the cavity and promotes the channeling of high velocity laminar air flow through the cavity. The cavity should be streamlined along its length to channel and retain the laminar air flow throughout the length of the club head, from the striking face 12 to the rear face.

It has been found that the cross sectional shape of the cavity having these aerodynamic qualities may be rounded, rectangular or have other irregular shapes. Various parameters are used to describe the dimensions and configuration of the cavity including the width and depth of the cavity with respect to the overall dimensions of the golf club head the width of the cavity with respect to the depth of the cavity, the aspect ratio of the cavity, and the transverse gradient angle. The values of these parameters which assist in defining the present invention are set forth in detail in this specficiation.

When a golf club head is made in accordance with the invention, the high energy air flow through the cavity causes a reduction of the aerodynamic drag force acting on the club head in the following manner. In a conventional club, the air that is impinged on the ball striking face generally creates a high pressure in this region, and as the air stream flows around the club head, it separates from the club head forming a low pressure region in the rear wake area located directly behind the club head. The differential between the high pressure region at the front of the club and the low pressure region behind the club causes an aerodynamic drag. In the present invention, the air flow through the cavity exhausts directly behind the club head into the low pressure area to raise the pressure at the rear of the club head and thus reduces the aerodynamic drag. The higher the pressure is raised at this rear point by the present invention, the greater the reduction in drag which enables the club head to be swung faster and more easily.

The force Fg required of a golfer to swing a golf club head can be written as the following equation:

$$Fg = \frac{W_c V_c^2}{2_g S} + D_c$$

where $W_c$ is the weight of the club head, $V_c$ is the club head velocity at impact with the golf ball, S is the distance of the club head travel, g is the acceleration of gravity and $D_c$ is the aerodynamic drag on the club head. Rewriting equation (1) as:

$$V_c = \sqrt{\frac{2_g S}{W_c}(F_g - D_c)}$$

illustrates that for a fixed force by the golfer Fg, the reduction of drag $D_c$ will result in increased club head speed $V_c$ at impact with the ball.

The air channeled through the upper cavity accelerates and travels at a higher velocity than the air traveling past the bottom of the club head. A restriction like restriction 26 shown in FIG. 4 further accelerates the air flow before it flows into the rear wake at the rear of the club. This higher velocity air creates a lower pressure level across the top of the club head than the pressure level across the bottom of the club head and therefore in effect creates a lift which reduces the apparent weight of the club.

In addition, the air channeled through the opening provides improved directional control during the swing by acting as a vertical stabilizer, analogous to the rudder on an aircraft or feathers on an arrow shaft, maintaining improved alignment of the club head in its swing path. This stabilizing effect allows a golfer to maintain better and more repetitive control of the club throughout the swing, enhancing consistency and the likelihood of squarely striking the golf ball.

The channeling of air through the cavity during the bottom of the swing of the club head tends to force the club head downwardly and more parallel to the ground for a longer distance than conventional clubs and also tends to keep the flight path of the club head on the optimum plane with respect to the intended flight path of the ball to be struck. A low and relatively straight path of the club head at the bottom of the swing is the most optimum swing path, and the channeling of air through the cavity promotes such a swing path. This channeling of air through the cavity produces a more optimum impact with the golf ball to permit a better momentum transfer, enabling maximum distance to be derived from the force applied to the swing. In addition, the air channeled in the cavity minimizes torquing or twisting of the club head at impact.

As previously indicated, the results achieved by the present invention occur when the cavity is substantially deep and wide with respect to the overall club head dimensions. Since these are general terms, the dimensions of the cavity may be expressed in a number of ways using a number of different parameters.

One way to define the cavity is relative to the overall dimensions of a golf club. Most golf club drivers have a club head width of approximately three (3) to four (4) inches from the toe to the heel and have a club head height of approximately one (1) to two (2) inches from the top surface of the club to the club head sole plate. Most conventional driver club heads also have a club head length of approximately 2 to 3 inches from the face of the club head to the rear of the club head. Fairway woods, such as number 2, 3, 4 and 5 woods, are usually progressively smaller but are usually at least 2½ inches from toe to heel and 1 to 2 inches from the top surface of the club to the club head sole plate. The cavity of the present invention can be applied to all standard and non-standard sized wood-type club heads which are designed to strike a golf ball in order to propel the ball a long distance.

Driver club heads typically have a club head face with a height of 1 to 2 inches. Driver golf club heads made according to the present invention should have a club head face height of at least 1 inch, a club head air cavity depth of at least ¼ inch, an air cavity width of at least ½ inch, a club head width from toe to heel of at least 2 inches, and a club head length from face to rear of at least 2 inches. Preferably, the width and the depth of the cavity are in a range of from 50% to at least 12% of the toe to heel and top surface to sole plate dimensions, respectively.

In the preferred embodiments, the aspect ratio, which has been previously defined as the square of the width between the top edges of the cavity divided by the cross sectional area, should be less than 20, more preferably in the range of less than 8. It will be appreciated that the cross sectional areas of various cavity cross sectional configurations may be determined using standard mathematical formulas and calculations in order to determine the aspect ratio.

Figure 46:
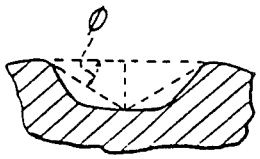
FIG. 46 is a partial cross sectional view of a golf club head of the present invention having a symmetrical cavity.

Still another way of defining the aerodynamic traits of the cavity configuration is by way of the transverse gradient taken at the point of maximum depth along a longitudinal line on the bottom of the cavity. The transverse gradient has been previously defined as the angle between a line from the bottom low point of the cavity at a transverse cross section of the cavity to the highest edge of the cavity and a line across the highest points at the top edge of the cavity. FIG. 46 shows the angle as defined above as an angle $\phi$. In the preferred embodiments, the angle preferably should be greater than 31°, more preferably greater than 10°. This angle $\phi$ for a symmetrical cavity may be determined precisely in degrees using the inverse tangent of the depth of the cavity divided by one-half of the width in accordance with the formula:

$$\phi = \mathrm{TAN}^{-1}\frac{D}{\frac{1}{2}W}$$

where D is depth and W is width of the cavity. This figure can then be looked up in a set of tangent tables to determine the exact angles. An average value of the two transverse gradient angles defined by an asymmetrical cavity can be used as an aerodynamic parameter to define the characteristics of such cavities. For example, the embodiment shown in FIG. 47 would have two transverse gradient angles $\phi$ and $\phi'$, and the average value of the transverse gradient would be calculated by adding the two values $\phi$ and $\phi'$ and dividing by two.

Through experimentation and application of the present invention, it has been found that to provide the desired results, the cavity of the present invention must have a depth of at least ¼ inch and a width of at least ½ inch, throughout a "substantial portion" of the cavity. In the preferred embodiments, the cavity also should have an aspect ratio of less than 20, more preferably less than 8, throughout a "substantial portion" of the cavity. Because no known formulas adequately define the characteristics of the present invention, it is difficult to define with mathematic precision just how much of the cavity's length must have the above characteristics in order to produce the beneficial results. Functionally, the "substantial portion" must be of sufficient length that the cavity will retain and channel the air flow and direct the air flow into the wake at the rear of the club head. From limited experimentation, it appears that to properly retain and channel air, the cavity must have the at least ¼ inch depth and at least ½ inch width at each transverse cross section along at least a ½ inch and preferably a 1 inch long section of the cavity. More preferably, the "substantial portion" should have a length which is at least half as long as the club head length from the face to the rear. The "substantial portion" could be at the front, middle, or rear of the cavity in the club head but should ultimately direct the high velocity flow of air into the wake of the club. For example, a "substantial portion" of a cavity is illustrated as middle portion a—a shown in FIG. 4. The "substantial portion" shown in FIG. 4 is centered at the longitudinal midpoint of the cavity and has a length greater than ½ of the entire length of the club head. In each of the embodiments shown in FIGS. 1–48, the cavities have the desired aerodynamic characteristics along at least ½ inch of the middle portions of the respective cavities. It is preferred that the cavity have these characteristics along the majority of the cavity's length. For example, in the embodiment shown in FIG. 4, the depth of the cavity is greater than ¼ inch along its middle, the width of the cavity is greater than ½ along its middle, and the aspect ratio is less than 8 at substantially every cross section along its middle. The cavity has these characteristics even at the restriction 26.

Unless a substantial portion of the cavity has the ¼ inch depth and ½ inch width limitations, the cavity will not sufficiently channel and retain an air flow that will reduce drag and provide the aerodynamic stabilizer which improves control. It is not, however, essential that the inlet and exhaust portions of the cavity meet these limitations to provide the desired effect. Similarly, it is not, essential that the cavity be ¼ inch deep immediately at the inlet or the exhaust. For example, the cavity shown in FIG. 4 does not have an aspect ratio of less than 8 or a depth of ¼ inch at the face of the golf club. Instead, the cavity gradually increases in depth from the inlet portion to smooth the transition of air flow.

To achieve the desired channeling effect, the cavity also must include upper, elongated, longitudinal edges which are continuous along the length of the cavity to provide a stabilizing effect on the air flow. In short, the transverse cross sectional area of the channel, defined by the walls and bottom of the channel, must be capable of channeling and retaining a high energy flow of air throughout the length of the channel. The restriction along the length of the cavity cannot be so severe that it impairs this channeling and retention of air. A cavity having these aerodynamic characteristics directs the retained high energy flow through an air flow restriction to the rear wake of the club head reducing drag and also provides a stabilizing effect.

The aerodynamic characteristics of a golf club and the cavity of the present invention are complex and are not sufficiently known to be capable of absolute precise definition. Experimentation and application of the invention have shown that at least the ¼ inch depth and at least ½ inch width limitations along a substantial portion of the cavity 22 are necessary to achieve the desired result. Cavities having these limitations as well as an aspect ratio of less than 20, and more preferably, less than 8, have proven to provide optimum performance. It appears that the depth of the cavity is a highly significant factor. For example, club heads having a shallow cavity with a depth of less than ¼ inch have not produced the improvements provided by the present invention. It is believed that such shallow recesses fail to channel and retain sufficient air and instead create air turbulence. On the other hand, it has been found that cavities having depths of approximately ½ inch and widths of ¾ inch to 1 3/16 inches provide considerably improved aerodynamic results over conventional clubs. Similarly, it has been found that such cavities having a width of at least ½ inch at the restriction provide the most beneficial results. It is believed that the increased depth of the cavity promotes the channeling and retention of air.

It is further believed that for cavities having channels of lesser depths, for example in the range of ¼ inch, it is important that the side walls of the cavity be sloped fairly steeply to better retain the flow of air. It appears that for cavities with greater depth, less inclined curved side walls can be utilized with no adverse effect. Thus, a channel design like that shown in FIG. 5 would be preferable for channels having a depth in the range of ¼ inch, while cavities having greater depths of ½ inch or more can have a sloped side walls.

In a preferred embodiment of the invention, the cavity would have a depth of at least ¼ inch along a substantial portion, a width of at least ¾ inch, an aspect ratio less than 6 along the majority of the length, a width at the restriction of at least ½ inch and an average transverse gradient of at least 10 degrees. A still more preferred embodiment of the invention would have a depth of at least ⅜ inch along the majority of its length, a width of at least 1 inch, an aspect ratio of less than 6 along the majority of its length, a width at the restriction of at least ½ inch and a transverse gradient of more than 12 degrees.

Having described in some detail the general aspects and parameters of the invention, the specification will now refer to and describe the specific embodiments shown in the drawings.

Figure 1:
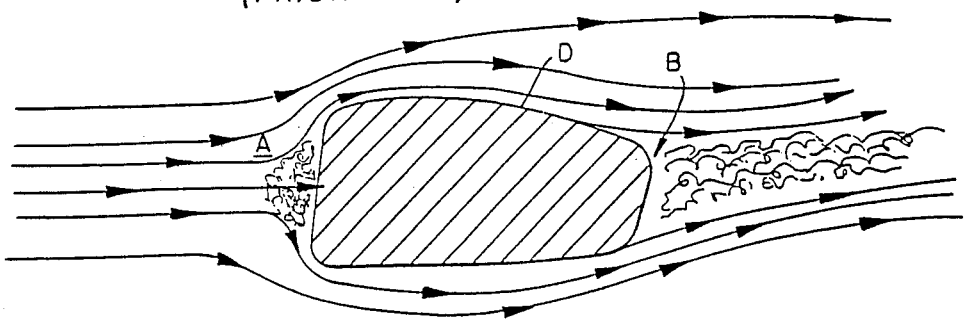
FIG. 1. (PRIOR ART)
FIG. 1 illustrates a sectional view of a conventional golf club showing air flow patterns around the club head when it is swung.

FIG. 1 shows a standard golf club head having an air flow as indicated by the air flow lines. In region A, the air is compressed against the face creating a high pressure region. As the air flows around the club head, it separates from the club head forming a low pressure region B at the immediate rear face of the club head. The aerodynamic drag associated with the club head is, determined by the difference in pressure in the areas A and B which act upon the club head.

Figure 2:
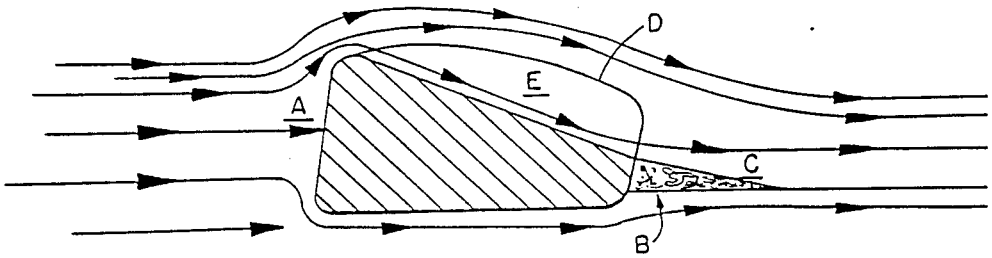
FIG. 2 illustrates a sectional view of a golf club head of the subject invention taken through the venturi slot showing air flow patterns.

In the present invention, illustrated in FIG. 2, the air flow through the channel E is exhausted into the base region C behind the club head raising the pressure and thus reducing the aerodynamic drag at this point.

In a preferred embodiment, for example, as shown in FIG. 2, the slot is shaped in the form of a venturi. Air in the venturi configuration tends to be accelerated as it approaches the throat F before it is exhausted out of the rear portion of the club head.

Figure 3:
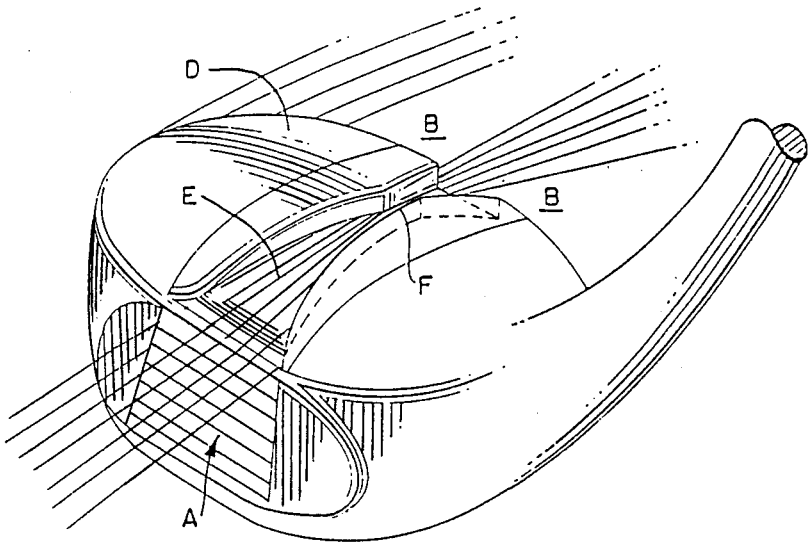
FIG. 3 is a perspective view of a golf club head of the present invention showing air flow patterns.
Figure 6:
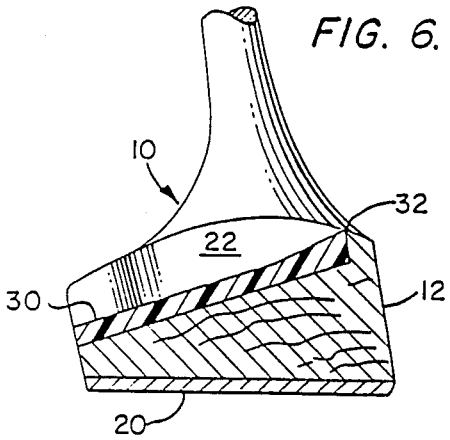
FIG. 6 is a side sectional view of the club head of FIG. 3 taken along the lines 6—6 of FIG. 5.
Figure 5:
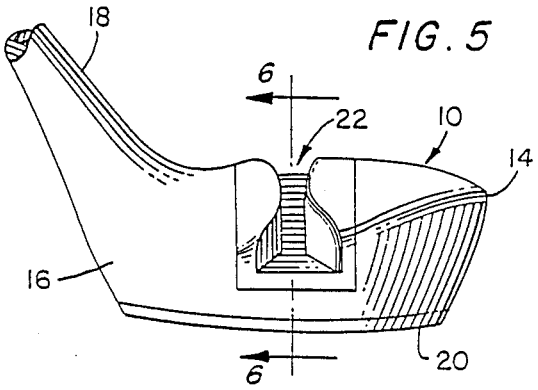
FIG. 5 is a rear elevational view of the club head of FIG. 3.

FIGS. 4, 5 and 6 illustrate top, rear and side sectional views of a club head 10 shown in FIG. 3. The club head is conventional in overall design and includes a ball striking face 12, a toe 14, heel 16, hosel 18 and a bottom with a sole plate 20. The club head is designed to be secured to a shaft and grip (not shown) to form a golf club used for playing the game of golf. The top of the club head is formed with an opening or cavity 22. The walls of the cavity are formed with a constriction so as to approximate the shape of a venturi duct extending from adjacent the club face 12 to the rear of the club head. The cavity includes an inlet portion 24, a throat or restriction 26 and an outlet 28. The bottom surface 30 of the cavity is essentially flat except for a slight incline where it meets the top 32 of the club head directly behind the ball striking face. The cavity may vary in depth depending on a particular club head design, but it is preferably in excess of ¼ inch between the top surface 32 of the club head and the bottom surface 30 of the cavity. The width of the cavity is substantially greater than the depth and is approximately ½ inch wide on a standard club head size which measures approximately 4 inches from heel to toe. The aspect ratio is less than 8:1 and the average transverse gradient angle is in excess of 14°.

It will be appreciated that the particular dimensions of the depth and width of the cavity will vary somewhat with the size of the club head itself. The dimensions are not limited except as described hereinabove.

The opening which forms the cavity is preferably made using an insert of molded plastic, metal or similar material which is then secured to the club head. However, it will be appreciated that the opening may be formed by an conventional techniques including cutting the opening directly into the top of the club head itself.

Figure 7:
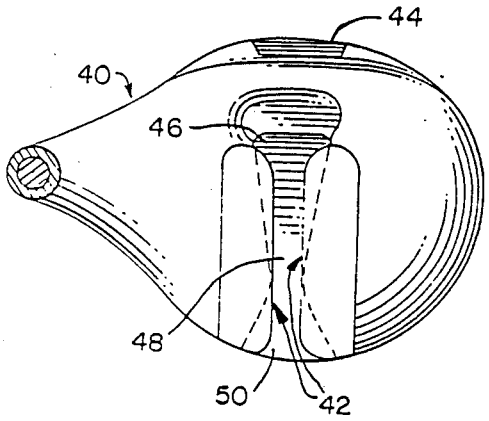
FIG. 7 is a top view of a second embodiment of the golf club head of the present invention.
Figure 9:
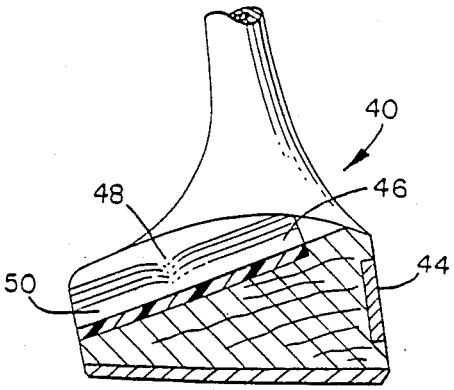
FIG. 9 is a side sectional view of the club head taken along line 9—9 of FIG. 7.
Figure 8:
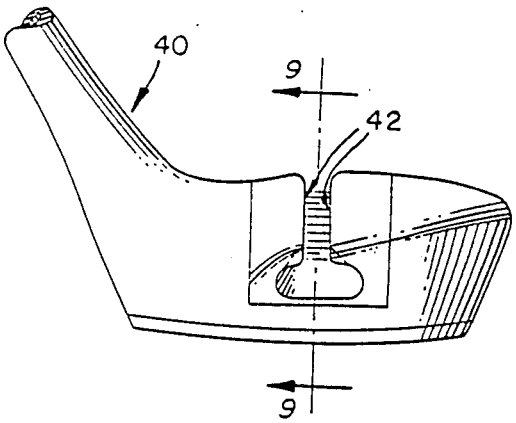
FIG. 8 is a rear elevational view of the club head of FIG. 7.

FIGS. 7, 8 and 9 show a golf club head 40, similar to the club head in FIGS. 4 to 6, having a cavity 42 with a restriction 48 disposed behind the club striking face 44. The inner surfaces of the cavity 42 which form the restriction 48 are curved inwardly in cross section, as seen in FIG. 8. Preferably, these surfaces are oval in cross section; however, any curved or round surface may be used. The surfaces gradually taper inwardly from the inlet 46 to, the restriction 48 and taper outwardly from the restriction 48 to the outlet 50, as seen in FIG. 7. The cavity 42 is also open at the top of the club head, as seen in the drawings. The cavity has the same effect as the embodiment shown in FIGS. 4 to 6 of reducing drag and increasing lift as the club is swung.

Figure 10:
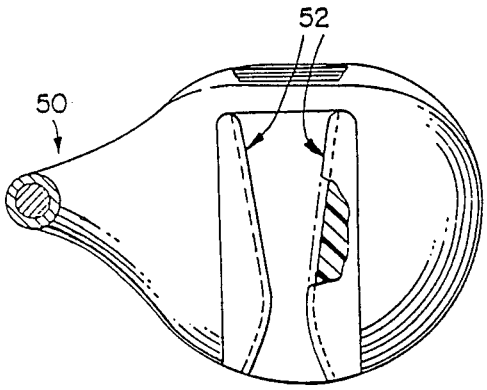
FIG. 10 is a top view of a third embodiment of the club head of the present invention.
Figure 11:
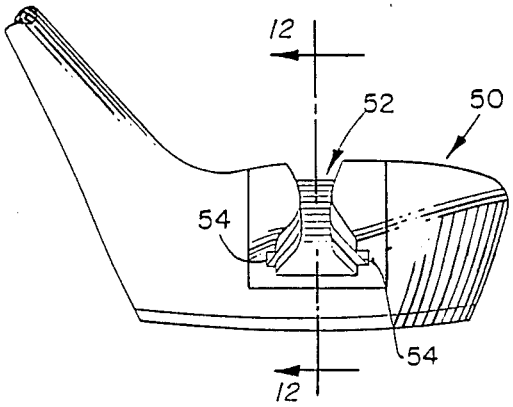
FIG. 11 is a rear elevational view of the club head of FIG. 10.
Figure 12:
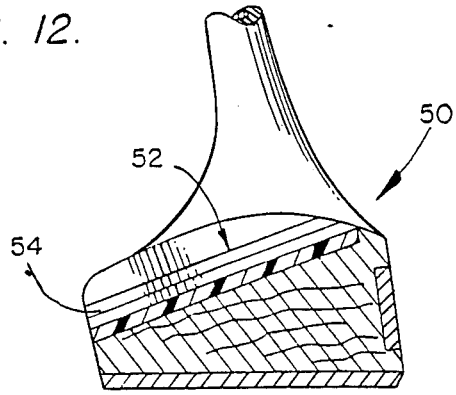
FIG. 12 is a side sectional view of the club head taken along line 12—12 of FIG. 11.

FIGS. 10, 11 and 12 show a golf club head 50 including a cavity 52 having a restriction which is the same configuration as the cavity shown in the club head 10 in FIGS. 4 to 6. In addition, the cavity 52 includes two undercut grooves 54 and 56 on each side of the cavity walls. The grooves 54 and 56 act as an additional drafting means to provide greater lift and stability as the club head is swung.

Figure 13:
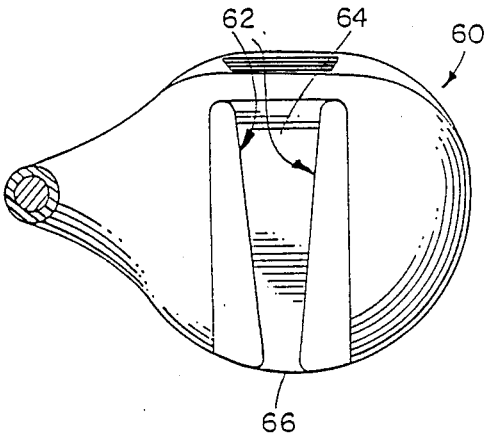
FIG. 13 is a top view of a fourth embodiment of the club head of the present invention.

FIG. 13 illustrates another embodiment of the present invention. A club head 60 includes a cavity 62 having an inlet 64 and a restriction at the outlet 66 located at the rear of the club head.

Figure 14:
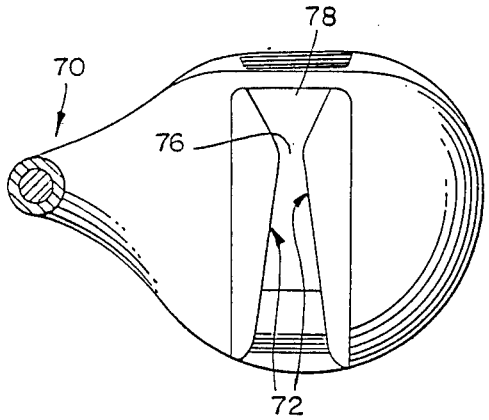
FIG. 14 is a top view of a fifth embodiment of the club head of the present invention.

FIG. 14 illustrates still another embodiment of the present invention. A club head 70 includes a cavity 72 having a restriction 76 which is disposed toward the inlet 78 of the channel 72.

Figure 15:
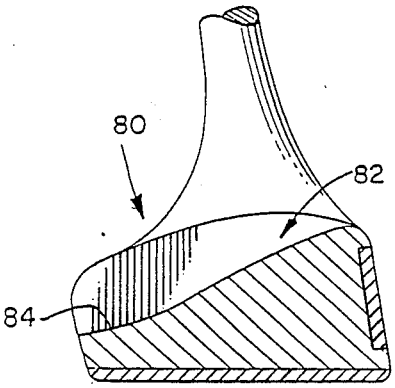
FIG. 15 is a side sectional view of the sixth embodiment of the club head of the present invention.

FIG. 15 illustrates a golf club 80 of the present invention shown in section along the center of a cavity 82. An aerodynamic surface 84 is formed as a concave depression in the bottom of the cavity 82.

Figure 16:
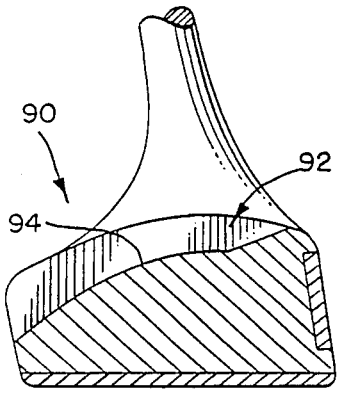
FIG. 16 is a side sectional view of a seventh embodiment of the club head of the present invention.

FIG. 16 shows a golf club 90 of the present invention shown in section along the center of a cavity 92. An aerodynamic surface 94 is formed as a raised or convex surface on the bottom of the cavity 92.

Figure 17:
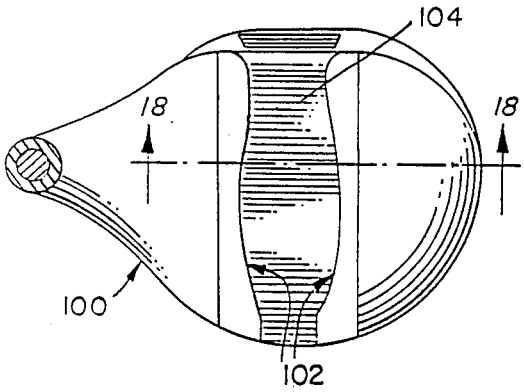
FIG. 17 is a top elevational view of an eighth embodiment of the club head of the present invention.
Figure 18:
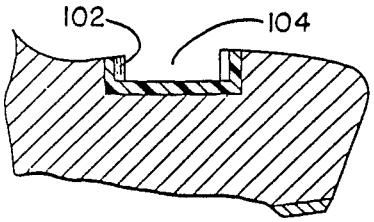
FIG. 18 is a sectional view taken along lines 18—18 of FIG. 17.

FIGS. 17 and 18 show a golf club 100 wherein the aerodynamic surfaces 102 are formed in the side walls, of a cavity 104 having a divergent or concave configuration. Each of the surfaces 102 are formed as an inverse venturi to create the pressure reduction surfaces.

Figure 19:
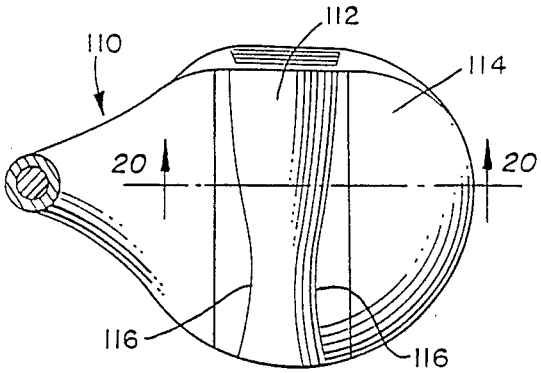
FIG. 19 is a top elevational view of a ninth embodiment of the present invention.
Figure 20:
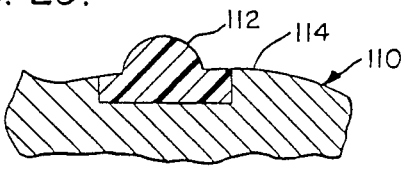
FIG. 20 is a sectional view taken along lines 20—20 of FIG. 19.

FIGS. 19 and 20 show a golf club head 110 having an aerodynamic configuration 112 in relief on the top 114 of the club head. The aerodynamic configuration 112 is shown with a pinched waist 116 or constriction which produces the low pressure region. The aerodynamic configuration may be formed above the club head surface as shown or the top surfaces of the club head on each side of the aerodynamic configuration may be scooped or otherwise removed to form the desired shape.

Figure 21:
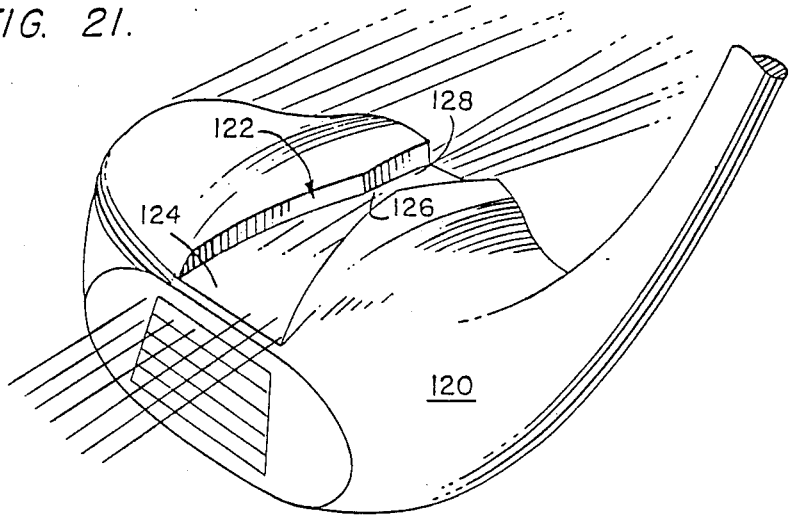
FIG. 21 is a perspective view of a tenth embodiment of the present invention.
Figure 22:
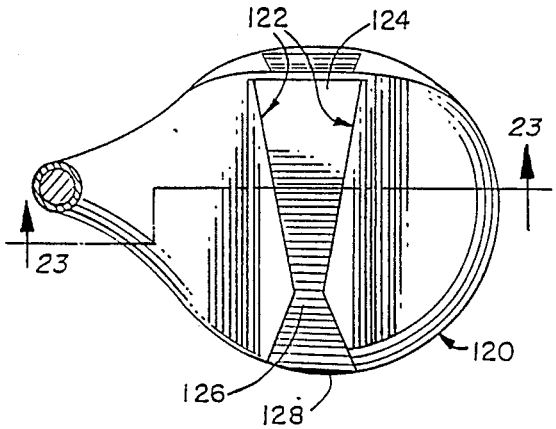
FIG. 22 is a top elevational view of the club head of FIG. 21.
Figure 23:
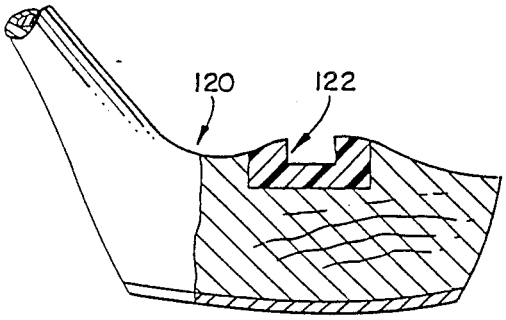
FIG. 23 is a sectional view taken along lines 23—23 of FIG. 22.

FIGS. 21, 22 and 23 illustrate another embodiment of the golf club head 120 of the present invention having an aerodynamic configuration 122 in relief on top of the club head. The aerodynamic configuration is formed of an inlet 124, a restriction 126 and an outlet 128. The toe 130 and the heel 132 of the club head 120 are "scooped," as shown in FIG. 23, to form the aerodynamic configuration 122 in relief.

Figure 24:
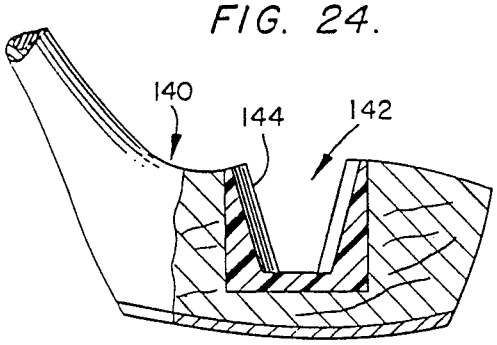
FIG. 24 is a side sectional view of an eleventh embodiment of the club head of the present invention.

FIG. 24 shows still another embodiment of a club head 140 having two alternate features. A cavity 142 which forms the aerodynamic configuration is shown at a cross section as extending greater than one half of the depth of the club head 140. Also, the side walls 144 of the cavity 142 are diverging from a center line extending longitudinally in the cavity 142.

Figure 25:
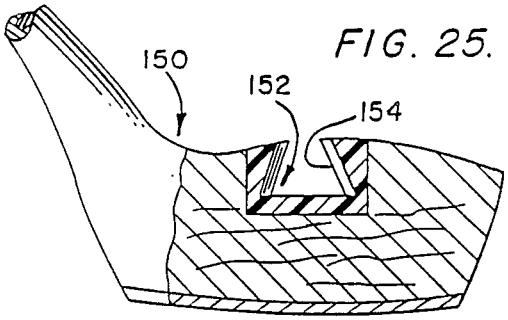
FIG. 25 is a side sectional view of a twelfth embodiment of the club head of the present invention.

FIG. 25 shows a golf club head 150 including an aerodynamic configuration wherein a cavity 152 is less than one half of the depth of the club head and the side walls 154 of the cavity 152 converge to a center line extending longitudinally in the channel.

Figure 26:
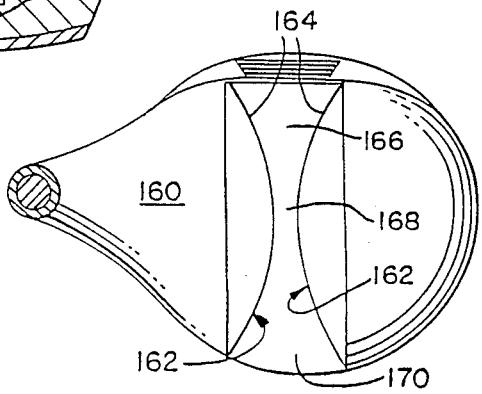
FIG. 26 is a top elevational view of a thirteenth embodiment of the present invention.

FIG. 26 illustrates a club head 160 wherein a cavity 162 is formed of symmetrical arcuate walls 164 providing a smooth transition between the inlet 166, restriction 168 and outlet 170 of the aerodynamic configuration.

Figure 28:
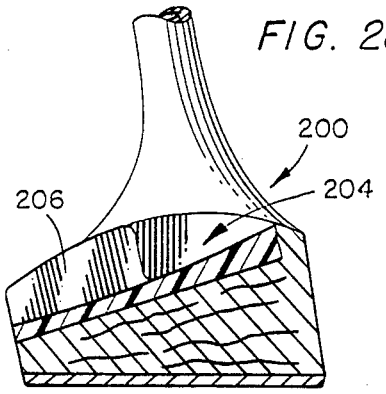
FIG. 28 is a side sectional view taken along lines 28—28 of FIG. 27.
Figure 27:
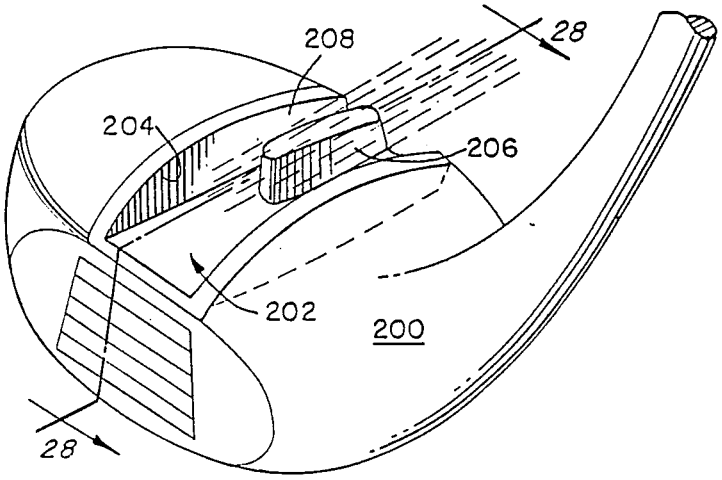
FIG. 27 is a perspective view of a fourteenth embodiment of the present invention.

FIGS. 27 and 28 disclose another embodiment of the present invention. A club head 200 is formed with a cavity 202 having straight walls 204 extending from the front to the rear of the club head 200. A vertical spacer 206 is positioned in the cavity 202 and acts to divert the air flow around the spacer 206. The walls 204 and the vertical spacer 206 define a restriction 208 formed by the spaces between the walls 204 and the spacer 206.

Figure 29:
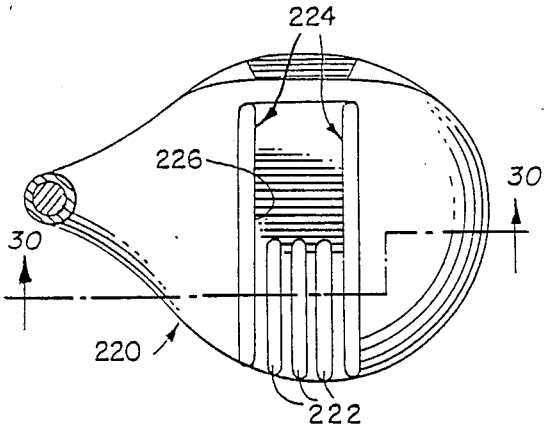
FIG. 29 is a top elevational view of a fifteenth embodiment of the present invention.
Figure 30:
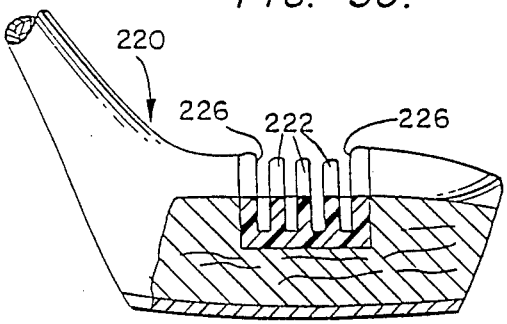
FIG. 30 is a rear sectional view taken along lines 30—30 of FIG. 29.

FIGS. 29 and 30 show a club head 220 having three vertical spacers 222 in a cavity 224. The area between the spacers 222 and the side walls 226 of the channel 224 define a multiple restriction configuration.

Figure 31:
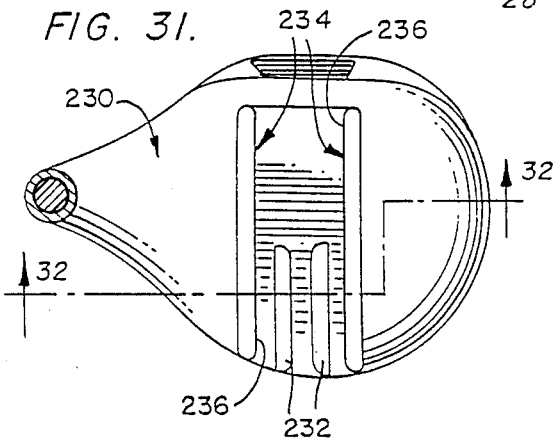
FIG. 31 is a top elevational view of a sixteenth embodiment of the present invention.
Figure 32:
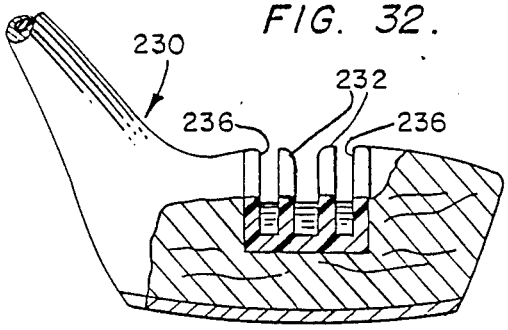
FIG. 32 is a rear sectional view taken along lines 32—32 of FIG. 31.

FIGS. 31 and 32 show still another embodiment of a club head 230 having two vertical spacers 232 in a cavity 234. The area between the two spacers 232 and the area between the spacers and the side walls 236 of the channel 234 define a multiple restriction configuration.

The spacers used in the embodiments of FIGS. 27 to 32 may be of any suitable shape, such as round, rectangular, bullet shaped, tear drop shaped, diamond shaped, eliptical, hexagonal or conical among others, or any combination thereof.

Figure 33:
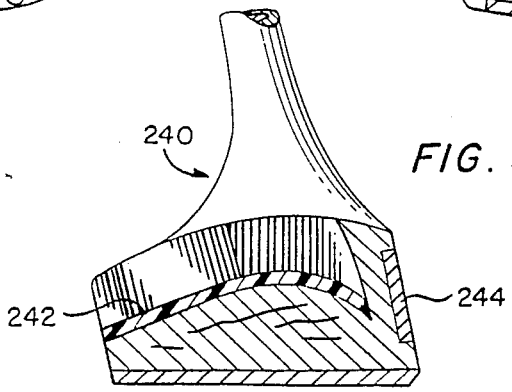
FIG. 33 is a side sectional view of a seventeenth embodiment of the present invention.
Figure 34:
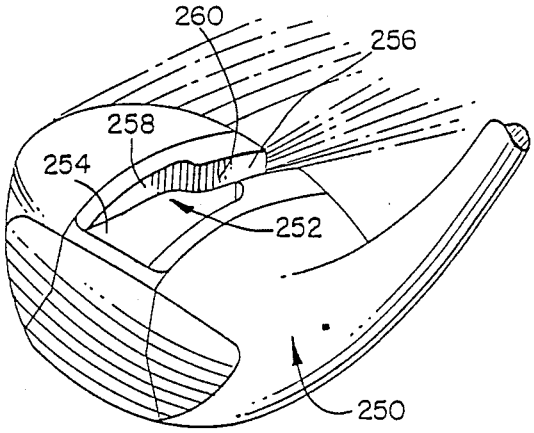
FIG. 34 is a perspective view of an eighteenth embodiment of the present invention.
Figure 35:
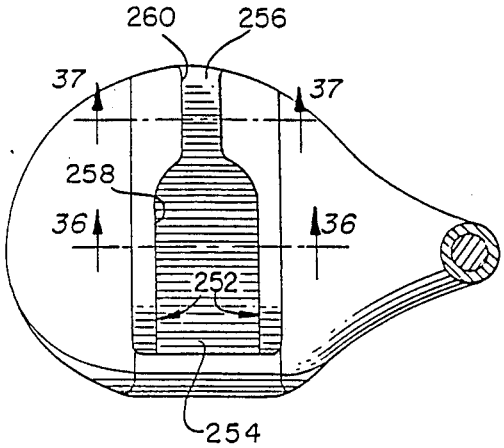
FIG. 35 is a top elevational view of the club head of FIG. 34.
Figure 36:
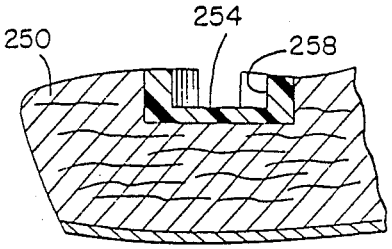
FIG. 36 is a sectional view taken along lines 36—36 of FIG. 35.
Figure 37:
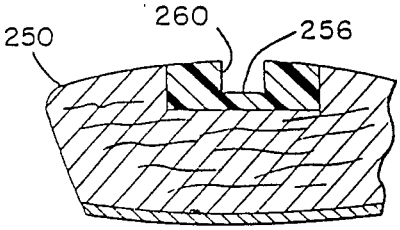
FIG. 37 is a sectional view taken along lines 37—37 of FIG. 35.

FIG. 33 is a sectional view of a club head 236 of the same general type as the club head 200 shown in FIGS. 27 and 28 except that the lower surface of a cavity 242 extends downwardly behind the striking face 244 of the club head 240 forming a hollow area behind the striking face 244. By forming the striking face of a suitable material, it can be made to permit flexing when the club head 240 is used to strike a ball.

FIGS. 34 through 37 show another embodiment of the present invention. A golf club head 250 is provided with an aerodynamic configuration 252 including an inlet 254 and restriction 256. The side walls 258 of the inlet 254 and the side walls 260 of the restriction 256 are made substantially parallel to each other. The ends of the walls 258 of the inlet 254 gradually converge to meet the walls 260 of the restriction 256 to form an aerodynamically smooth surface.

Figure 38:
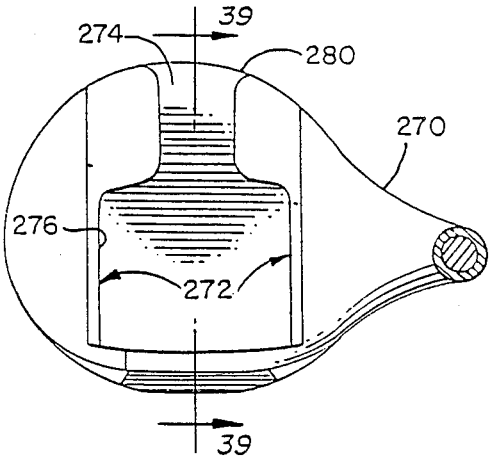
FIG. 38 is a top elevational view of a nineteenth embodiment of the present invention.

FIG. 38 illustrates another embodiment of the club head of the present invention similar to that shown in FIGS. 34–37. A golf club head 270 is formed with an aerodynamic configuration having an inlet 272 which extends across a substantial portion of the top surface of the golf club head 270. A restriction 274 is formed at the rear of the club head 270 and is narrower than the inlet 272. The rear of the cavity is flared to form an outlet 280. In this embodiment, the side walls 276 of the inlet 272 and the side walls 278 of the restriction 274 are straight and parallel to each other. However, it will be appreciated that the walls may be angled with respect to each other and still maintain the aerodynamic properties.

Figure 39:
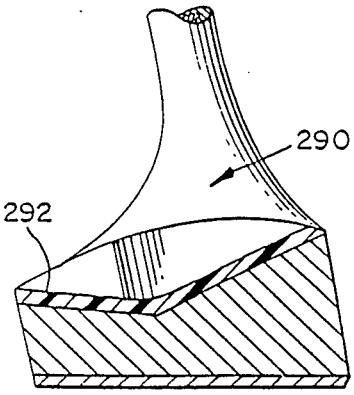
FIG. 39 is a side sectional view of a twentieth embodiment of the present invention.
Figure 40:
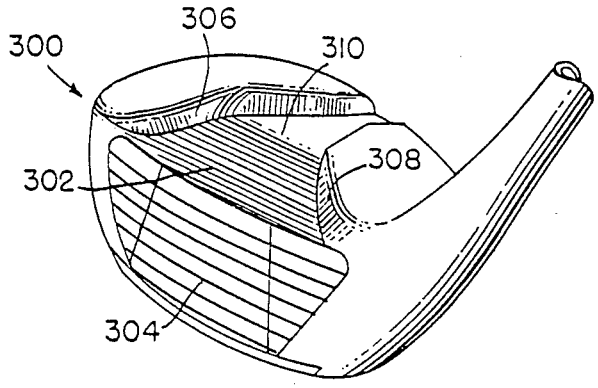
FIG. 40 is a perspective view of a twenty-first embodiment of the present invention.
Figure 41:
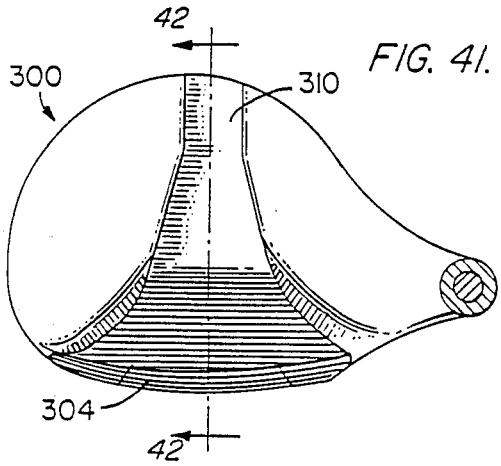
FIG. 41 is a top plan view of the club head of FIG. 40.
Figure 42:
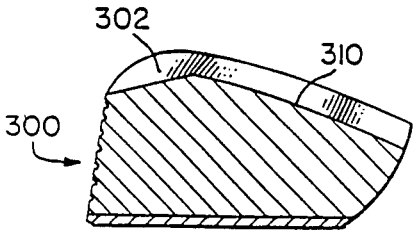
FIG. 42 is a side sectional view of the club head of FIG. 40.
Figure 43:
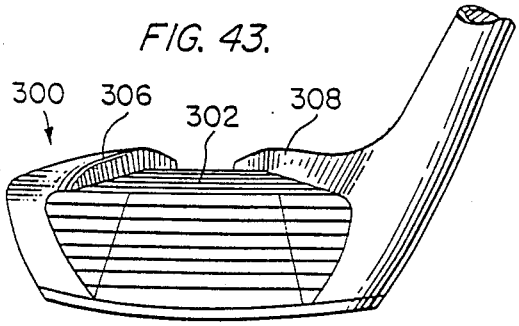
FIG. 43 is a front elevational view of the club head of FIG. 40.

FIG. 39 illustrates another embodiment of the present invention showing a club head 290 similar to the club head 250 shown in FIGS. 34–37. The bottom surface 292 is shown sloping upwardly so that it meets the top surface of the club head at its rear point while still maintaining an effective aerodynamic configuration.

FIGS. 40, 41, 42 and 43 show perspective, top plan and side sectional views of still another embodiment of a golf club head 300 of the present invention. The club head 300 is also conventional in design except for the inclusion of a wide cavity 302, the forward portion of which extends substantially across the entire ball striking face 304. The cavity 302 gradually decreases in width as it approaches the rear of the club head so that the forward width is at least twice as wide as the rearward width. Preferably, the side walls 306 and 308 are angled gradually to present smooth aerodynamic surfaces from the wide forward portion of the cavity to the narrow rear portion of the cavity. The side walls 306 and 308 may be perpendicular to the bottom surface 310 of the cavity 302 or they may be slightly angled or curved as long as the aspect ratio is less than 8 and average transverse gradient angle is in excess of 14°. The cavity restriction is defined by the gradually decreasing width in the cavity from the front to the rear along the longitudinal axis of the cavity 302.

Figure 44:
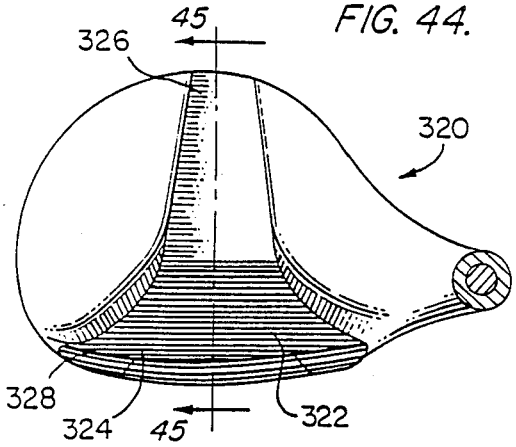
FIG. 44 is a top elevational view of a twenty-second embodiment of the present invention.
Figure 45:
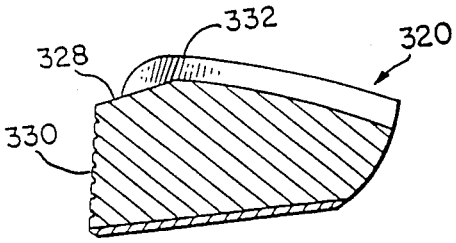
FIG. 45 is a side sectional view of the club head of FIG. 44.

FIGS. 44 and 45 show another embodiment of the present invention. A club head 320 includes a cavity 322 having a wide mouth or forward portion 324 and a gradually decreasing width toward the rear portion 326 which is essentially the same as the cavity of the embodiment shown in FIGS. 40–43. This embodiment also includes a ledge 328, as clearly shown in FIG. 45, directly behind the ball striking face 330 and below the top surface 332 of the club head 320. The ledge 328 reduces the top surface of the ball striking face 330 to eliminate some air resistance as the air spills over the top edge of the ball striking face and is guided into the cavity 322.

Figure 47:
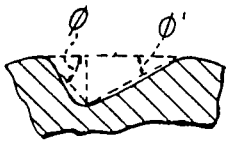
FIG. 47 is a second partial cross-sectional view of a golf club head of the present invention having an asymmetrical cavity.
Figure 48:
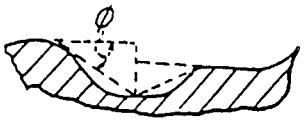
FIG. 48 is a third partial cross-sections view of a club head of the present invention having a different asymmetrical cavity.

FIGS. 46, 47 and 48 show partial sectional views of the cavity cross section of the club head. The cavity cross sectional shape may be symmetric or asymmetric.

When symmetric, the highest peak of the club head on each side of the cavity till be substantially equal in height and have substantially equal transverse gradients angles on each side of a bottom low point of the cavity. When asymmetric, the cavity cross sectional shape may have: (1) both highest peaks on each edge of the cavity of equal height but the transverse gradients from the bottom low point or the deepest point of the cavity are not equal; (2) substantially equal transverse gradients from the bottom low point of the cavity, but the highest peaks on each edge of the cavity are not of equal height; and (3) any combination of (1) and (2) above. For example, FIG. 46 shows a symmetrical cavity with the bottom low point in the center, and the transverse gradient angles Ω on each side are equal. FIG. 47 shows an asymmetrical cavity shape in a club head where the bottom low point is located to one side of the cavity, and the transverse gradients angels are not equal. The top edges of the cavity are equal. FIG. 48 shows an asymmetrical cavity shape where the bottom low point is the center, but the highest peaks on the edges of the cavity are not of equal height. Notwithstanding the various shapes contemplated by FIGS. 47 and 48, the aspect ratio as well as at least one transverse gradient angle will fall within the limits of less than 20 aspect ratio and more than 3 degree transverse gradient angle, as defined above.

Some embodiments are shown with cavities in the top of the club head formed out of a metal, plastic or the like insert, whereas some embodiments are shown with the channel-shaped cavity formed directly into the wood or metal surfaces. Either arrangement is suitable, depending upon the particular club head material, without departing from the scope of the present invention.

Various channel configurations and other aerodynamic surfaces shown in this application are interchangeable without departing from the scope of the present invention. For example, the undercut grooves, as described with respect to FIGS. 10 to 12, may be used on any of the various embodiments shown. Similarly, a plurality of aerodynamic surfaces or aerodynamic surfaces or venturi type surfaces may be provided on the club head. It is intended that the specification and examples be considered as exemplary, while the true scope and spirit of the invention is defined by the claims.

What is claimed is:

1. A golf club head for a wood-type golf club to be swung at high velocities comprising:

a club head having a ball striking face, a rear face, a heel, a toe, a top surface and a bottom, the ball striking face being made to strike a golf ball and having a height which is at least 50% of the distance between the top surface and the bottom surface of the club head;

aerodynamic means for (1) raising the pressure at the rear of the club head and thus reducing the aerodynamic drag on the club head to provide greater acceleration for increased club head speed for a given force when swinging the club, (2) increasing the aerodynamic lift on the club head to provide a lighter swing feel, and (3) stabilizing the club head during its swing and at impact with the ball to provide improved directional control;

said aerodynamic means including an elongated, deep cavity having side walls and a bottom surface which form an air channel of sufficient depth and width to channel, retain and exhaust a high energy flow of air directly behind the club head;

said cavity being located in the top surface of said club head and extending substantially perpendicular to and rearwardly from adjacent said ball striking face to said rear face and forming two elongated top edges at the juncture with said top surface of said club head, said edges providing a stabilizing effect on the flow of air by defining flow lines independent of club head speed;

said cavity including an air flow restriction formed between said ball striking face and said rear face and serving to accelerate the flow of air through said cavity; and said cavity having a depth of at least ¼ inch and a width of at least ½ inch along a substantial portion of the cavity;

whereby the flow of high energy air through said cavity, when the club head is swung at high velocities, raises the pressure at the rear of the club head and acts as a vertical stabilizer which tends to maintain a square face alignment of the club head.

2. The golf club of claim 1 wherein said restriction is formed in the shape of a venturi.

3. The golf club of claim 2 wherein the cavity has a depth of at least ¼ inch and a width of at least ½ inch along the middle portion of said cavity.

4. The golf club head of claim 2 wherein the width of the cavity along substantially the entire length of the cavity is substantially greater than the cavity's depth.

5. The golf club of claim 2 wherein the cavity has an aspect ratio of less than 20 along at least a ½ inch portion of said cavity.

6. The golf club head of claim 1 wherein the cavity has a depth of at least ¼ inch and a width of at least ½ inch along at least a ½ inch long portion of the cavity.

7. The golf club head of claim 6 wherein the cavity has an aspect ratio of less than 8 along at least a ½ inch portion of said cavity.

8. The golf club head of claim 6 wherein said cavity has a depth dimension of at least ⅜ inch along a substantial portion of said cavity.

9. The golf club head of claim 6 wherein the cavity has a depth dimension of at least ½ inch along a substantial portion of said cavity.

10. The golf club head of claim 6 wherein said cavity has a width of at least one inch along substantially the entire length of the cavity.

11. The golf club head of claim 6 wherein said cavity slopes downwardly from adjacent said ball striking face toward said rear face.

12. The golf club head of claim 1 wherein the cavity has a depth of at least ¼ inch and a width of at least ½ inch along at least a 1 inch long portion of the cavity.

13. The golf club head of claim 12 wherein the cavity has an aspect ratio of less than 8 along at least a 1 inch portion of said cavity.

14. The golf club of claim 1 wherein said restriction is located in the back half of said cavity.

15. The golf club head of claim 14 further including an upwardly sloped surface directly behind said ball striking face and positioned between said ball striking face and said cavity.

16. The golf club of claim 1 wherein a longitudinal groove is formed in each side wall of said cavity.

17. The golf club of claim 1 wherein said side walls taper inwardly to form said restriction and then taper outwardly.

18. The golf club of claim 1 wherein said side walls form convex wall surfaces that narrow to form said restriction.

19. The golf club of claim 1 wherein said side walls form concave wall surfaces.

20. The golf club of claim 1 wherein said cavity includes an aerodynamic configuration on the bottom surface of said cavity.

21. The golf club of claim 20 wherein said aerodynamic configuration is a raised curvature on the bottom surface of said cavity.

22. The golf club of claim 20 wherein said aerodynamic configuration is a curved depression on the bottom surface of said cavity.

23. The golf club of claim 1 wherein said side walls slope inwardly to form a v-shaped cavity.

24. The golf club head of claim 1 wherein the cavity has an aspect ratio of less than 20 along a substantial portion of said cavity.

25. The golf club head of claim 1 wherein the cavity has an aspect of less than 8 along a substantial portion of said cavity.

26. The golf club head of claim 1 wherein the cavity has a transverse gradient angle of more than 3 degrees along a substantial portion of said cavity.

27. The golf club head of claim 1 wherein the cavity has a transverse gradient angle of more than 10 degrees along a substantial portion of said cavity.

28. The golf club head of claim 1 wherein the cavity has an aspect ratio of less than 3 along the middle portion of said cavity.

29. The golf club head of claim 1 wherein the depth of said cavity progressively increases from the front of said cavity to the rear of said cavity.

30. The golf club head of claim 1 wherein said bottom surface of said cavity is planar and said walls of said cavity are perpendicular to said bottom surface.

31. The golf club head of claim 1 wherein said bottom surface of said cavity is planar.

32. The golf club head of claim 1 wherein said cavity is flared outwardly from said air flow restriction toward said rear face.

33. The golf club head of claim 1 wherein said cavity includes a flared opening adjacent said ball striking face.

34. The golf club of claim 1 wherein a vertical spacer positioned between said sides walls for less than the total length of said cavity combines with said side walls to form said restriction.

35. The golf club of claim 34 wherein said spacer is vertically disposed in the rear half of said channel.

36. The golf club of claim 1 wherein a plurality of vertical spacers positioned between said side walls for less than the total length of said cavity combine with said side walls to form said restriction.

37. The golf club of claim 1 wherein the frontal portion of said cavity is substantially wider than said rearward portion and the side walls of said cavity taper inwardly to form said restriction.

* * * * *